United States Patent [19]

Harada

[11] 4,058,305

[45] Nov. 15, 1977

[54] PAPER FEEDING DEVICE

[75] Inventor: Masaaki Harada, Atsugi, Japan

[73] Assignee: Rank Xerox Ltd., London, England

[21] Appl. No.: 709,036

[22] Filed: Aug. 16, 1976

[30] Foreign Application Priority Data

Sept. 25, 1975 Japan ..... 50-114857

[51] Int. Cl.[2] ..... B65H 3/42; B65H 5/02

[52] U.S. Cl. ..... 271/16; 271/21; 271/271; 271/265

[58] Field of Search ..... 271/16, 17, 19, 12, 271/21–25, 271, 265, 275

[56] References Cited

U.S. PATENT DOCUMENTS

| | | | |
|---|---|---|---|
| 1,242,520 | 10/1917 | Cameron | 271/23 |
| 1,622,518 | 3/1927 | Johnson | 271/23 |
| 3,031,187 | 4/1962 | Sano et al. | 271/19 |
| 3,241,831 | 3/1966 | Axlid | 271/265 X |
| 3,395,912 | 8/1968 | Tappolet et al. | 271/16 |
| 3,527,457 | 9/1970 | Schaller | 271/19 |
| 3,627,307 | 12/1971 | van der Does | 271/19 X |

*Primary Examiner*—Robert W. Saifer

[57] ABSTRACT

A sheet feeding device wherein a roll pair in contact to the top sheet of a sheet stack is adapted to buckle the top sheet to enable subsequent engagement of the buckled portion of the sheet by a hooked belt to feed the buckled sheet off the stack in a direction substantially parallel to the axis of the buckle roll pair.

2 Claims, 6 Drawing Figures

PAPER FEEDING DEVICE

BACKGROUND OF THE INVENTION

This invention relates to a paper feeding device for use in an electrophotographic copying machine.

Hitherto, paper feeding devices for electrophotographic copying machines have been provided with a pair of paper feeding rollers which rotate in opposing direction to each other above the sheet tray for buckling the top sheet of the paper stock, stored in the tray, or have utilized vacuum for providing a buckle in the top sheet. These devices are not completely reliable in that double-feeding or misfeeding may occur, resulting in unacceptable reliability.

The aforesaid problems have been caused by the fact that conventional paper feeding devices have been served the dual functions of stripping sheets as well as feeding sheets and hence the function of the sheet feeding device is somewhat comprised.

This invention is directed to avoiding the aforesaid disadvantages by providing a paper feeding device for use in an electrophotographic copying machine which is provided with a mechanism for buckling and feeding copy papers from a stack one by one with improved reliability.

SUMMARY OF THE INVENTION

A paper feeding device comprising a pair of rollers which are provided in a contacting relationship with the top sheet of a sheet stock disposed within a paper tray and are rotated in a direction to buckle the top sheet, a fixing member being provided between the rollers for retaining the buckled portion of the sheet. A belt is provided above the fixing member for feeding the sheet by gripping the buckled portion with a hook member.

DESCRIPTION OF THE PREFERRED EMBODIMENT

Figure 1:
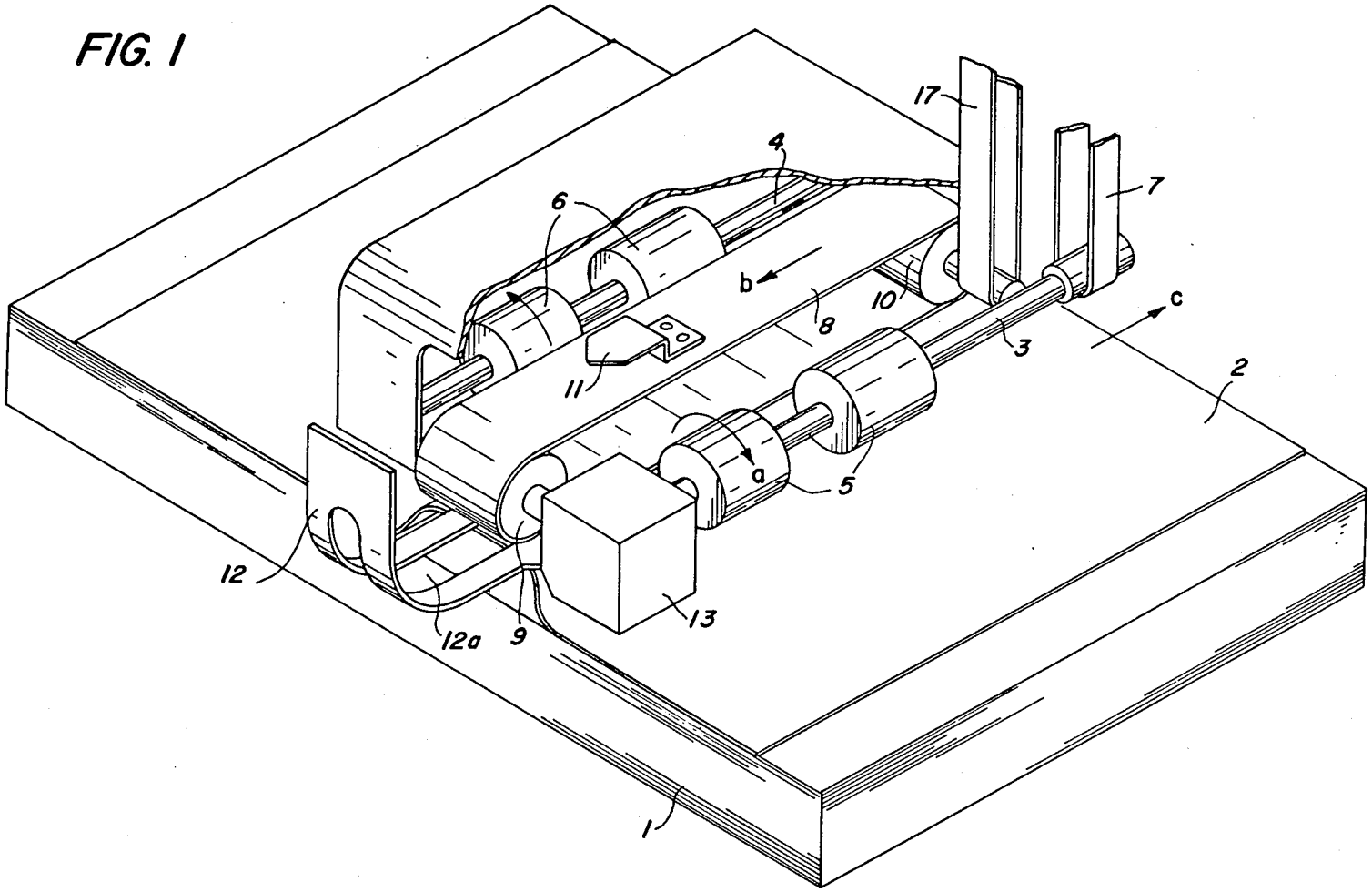
FIG. 1 is a perspective view of an embodiment of the paper supplying device according to the invention.
Figure 2:
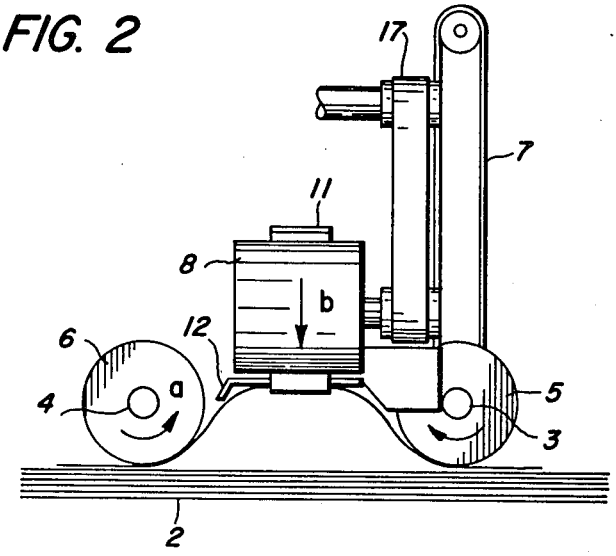
FIG. 2 is a front elevation of FIG. 1.
Figure 3:
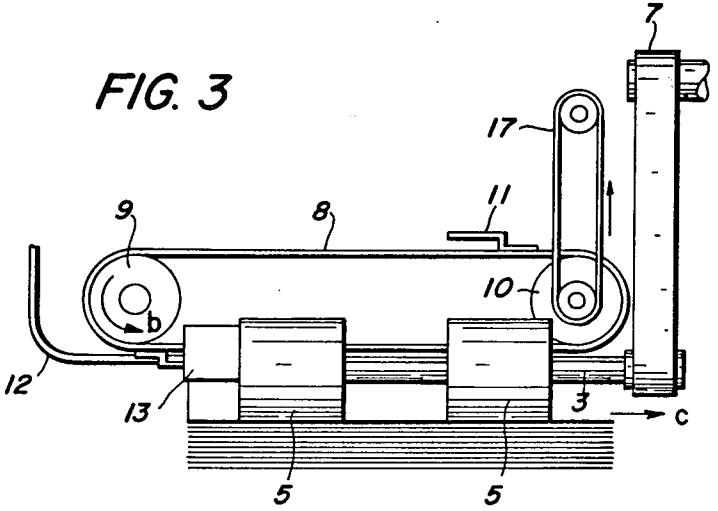
FIG. 3 is a side view of FIG. 1.

As is clearly shown in FIG. 1 to FIG. 6, there is shown at 1 a paper tray in which papers 2 to be supplied are stored. Provided above the paper tray 1 are a pair of driving shafts 3 and 4 which are provided in a manner to cross with the longitudinal direction of the paper 2 in space-parallel relationship to each other, the driving shafts 3 and 4 being provided in the longitudinal direction with a pair of stripping rollers 5 and a pair of stripping rollers 6 in a spaced relation to each other. Designated at 7 is an endless belt which is provided between each end of the driving shafts 3 and 4 and a driving mechanism (not shown) so that each of the stripping rollers 5 and 6 may rotate in a direction as indicated by the arrow. An endless belt 8 is provided between the stripping rollers 5 and 6. The paper supplying belt 8 is rotatably provided between a pair of rollers 9 and 10 which are positioned above the papers 2 and is supported in a direction to cross with the driving shafts 3 and 4, one of the rollers 10 being adapted to cooperate with a mechanism (not shown) through an endless belt 17 to be rotated in a direction as indicated by an arrow *b*. A hook member 11 is provided on the upper surface of the belt 8 for gripping the buckled portion of the paper 2, to thereby feed the paper sideways. Provided below the belt 8 is a stripped paper fixing member 12 which has a long hole 12 through which the hook member 11 passes.

Figure 5:
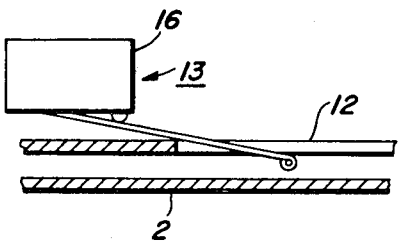
FIG. 4 and FIG. 5 are explanatory views of a detector.
Figure 4:
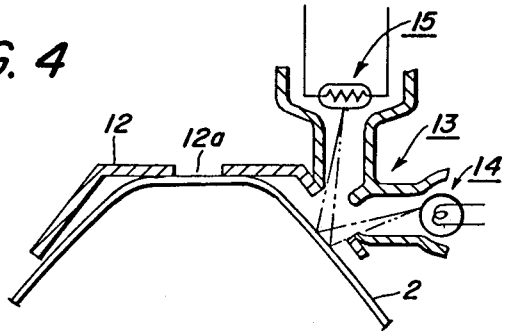
Figure 6:
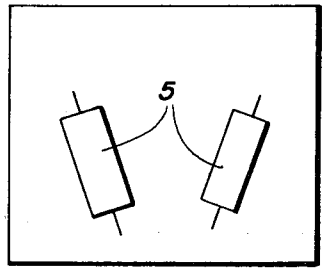
FIG. 6 is an explanatory view of another embodiment of stripping rollers.

Shown at 13 in the drawings is a detector for detecting the existence of paper 2 in the stripped paper fixing member 12, the detector being adapted to detect a reflected ray of the light emitted from a light source 14 through a light receiver 15, as shown in FIG. 4. Alternatively, the detector may employ a limit switch 16 which operates upon contact with the paper 2, as shown in FIG. 5.

Thus, in supplying papers, the rollers 5 and 6 are rotated in opposing direction to each other to buckle one of the copy papers 2 which are accumulated in the paper tray 1 and the thus stripped-paper fixing member 12 retains the buckled portion of the paper. Next, when the retension of the paper 2 is detected by the detector 13, the paper supplying belt 8 starts to rotate and grip the buckled portion of the paper 2 with the hook member 11, so that the paper can be fed into the direction as indicated by the arrow C.

In the embodiment shown, the rollers 5 and 6 are provided in parallel relationship to each other, however, these may be provided with an angle therebetween. Further, if the rollers 5 and 6 are provided near the ends of the paper, it becomes easier to feed papers because of the lack of pressure of the rollers.

As is apparent from the foregoing detailed description, according to the present invention, one sheet is stripped from the rest of copy papers by the stripping rollers and is gripped by the hook member provided on the paper supplying belt, whereby the papers are fed one by one in a secure manner and double-feeding or unbalanced-feeding can be prevented. Furthermore, since the paper is gripped at the buckled portion, which is strengthened, even thin papers can be smoothly fed, and the device is improved in reliability by providing a detector for detecting the existence of papers.

While the invention has been described with reference to the structure disclosed, it is not confined to the details set forth, but is intended to cover such modifications or changes as may come within the scope of the following claims.

What is claimed is:

1. A paper feeding device for feeding sheets individually from the top of a sheet stack comprising:

first and second counter-rotating rollers adapted to drive the ends of the top sheet in the stack towards each other to form a buckle therein; and, belt means disposed above said stack, the belt path being substantially parallel to the axis of said rollers, said belt means having a hook member associated therewith adapted for contact with the buckled portion of the top sheet, movement of the belt causing the hook member to feed the buckled sheet from the stack in a direction substantially parallel to the axis of said rollers.

2. A sheet feeder according to claim 1 wherein said first and second rollers are parallel to each other.

* * * * *